United States Patent [19]

Barreca

[11] Patent Number: 4,545,745

[45] Date of Patent: Oct. 8, 1985

[54] PERISTALTIC PUMP

[76] Inventor: John R. Barreca, 532 Singletree Ct., Richland, Wash. 98352

[21] Appl. No.: 682,568

[22] Filed: Dec. 14, 1984

Related U.S. Application Data

[63] Continuation of Ser. No. 440,970, Nov. 12, 1982, abandoned.

[51] Int. Cl.[4] ..... F04B 43/12; F04B 45/08

[52] U.S. Cl. ..... 417/477

[58] Field of Search ..... 417/477, 476, 475, 474

[56] References Cited

U.S. PATENT DOCUMENTS

| | | | |
|---|---|---|---|
| 315,667 | 4/1885 | Serdinko . | |
| 328,472 | 10/1885 | Faller . | |
| 910,125 | 1/1909 | Graser | 417/477 |
| 3,039,442 | 6/1962 | Hornschuch et al. | 417/477 |
| 3,175,507 | 3/1965 | Rydberg | 417/477 |
| 3,216,362 | 11/1965 | Hewko | 417/477 |
| 3,397,739 | 8/1968 | Miller | 417/477 |
| 3,829,251 | 8/1974 | Schwing | 417/477 |
| 3,875,970 | 4/1975 | Fitter . | |
| 4,347,778 | 9/1982 | Murray | 417/477 X |

FOREIGN PATENT DOCUMENTS

| | | | |
|---|---|---|---|
| 1191815 | 4/1959 | France | 417/477 |
| 1222643 | 1/1960 | France | 417/477 |
| 331944 | 9/1958 | Switzerland | 417/477 |
| 590045 | 7/1947 | United Kingdom | 417/477 |

OTHER PUBLICATIONS

Vanton Flex-i-Liner Sealless Plastic Pumps brochure, 1977, Vanton Pump & Equipment Corp.

*Primary Examiner*—Richard E. Gluck
*Attorney, Agent, or Firm*—Christopher Duffy

[57] ABSTRACT

The pump has a diaphragm and backing member which extend opposite one another and have strips of resiliently yieldable pairs of fingers operatively co-extensively disposed thereopposite to cause the diaphragm and backing member to define an elongated fluid flow path having an inlet and an outlet spaced apart from one another lengthwise the line of flow. The pump has rollers which are movable lengthwise along the line of flow in engagement with the diaphragm. The diaphragm and backing member are operatively interconnected with one another so that when a roller undergoes movement toward the outlet from the inlet, it displaces each longitudinally successive portion of the diaphragm in the direction opposed to the bias of a pair of fingers operatively disposed thereopposite, independently of the remaining pairs of fingers in the space between the inlet and the outlet, to progressively constrict the cross-section of the path and drive the fluid along the path. Each of the respective pairs of fingers is operable independently of the remaining pairs of fingers to restore the corresponding portion of the diaphragm disposed thereopposite to the relatively undisplaced condition thereof when a roller has displaced the respective portion and moved onto the next successive portion in the direction of flow.

19 Claims, 8 Drawing Figures

88
20
86
78
14
76
22
24
84
70
72
14'
54
26
98
28
78
74
21
14"
106
90
94
114
18
22'
95
40
24'
26'
92
8'
10'
30
8
96
97
96
10
28'
30'
48
50
46
82
42
80
56
44
4
54
62
66
46
60
58
64
16'
50
16
16"
52
68
72
90
94
82
80
70

PERISTALTIC PUMP

This a continuation of Ser. No. 06/440,970 filed Nov. 12, 1982, now abandoned.

THE INVENTION IN GENERAL

This invention relates to a peristaltic pump, and in particular, a peristaltic pump which does not rely on the memory of the relatively flexible fluid-flow-path-defining member to restore the cross section of the path to its normal condition when the relatively movable member of the pump has flexed each longitudinally successive portion of the flexible member and moved on to the next successive portion in the direction of travel.

According to the invention, the pump includes a pair of discrete and separable first and second members which extend opposite one another and have yieldable biasing means operatively co-extensively disposed opposite the bodies thereof to cause the members to separate from one another and define an elongated fluid flow path therebetween which has an inlet and an outlet spaced apart from one another lengthwise the line of flow thereof. It also includes a third member which is movable lengthwise the line of flow of the path in engagement with the first member. The first and second members are displaceable by flexure and resistant to flexure, respectively, in those cross-sectional planes of the path transverse the line of flow thereof, and are operatively interconnected with one another in the path defining condition thereof so that when the third member undergoes movement through the respective planes in the longitudinal direction of the line of flow relatively toward the outlet from the inlet, it displaces each longitudinally successive portion of the first member in the direction opposed to the bias of the corresponding longitudinally successive portion of the biasing means operatively disposed thereopposite, to progressively constrict the cross-section of the path from plane to plane and drive the fluid along the path. The biasing means are separate and detached from the bodies of the first and second members, externally thereof, so that the biasing means are operable to separate simultaneously all mutually opposing portions of the first and second members from one another over the entire length of the flow path from the inlet to the outlet thereof, but each of the respective portions of the biasing means is yieldable to the displacement of the corresponding longitudinally successive portion of the first member operatively disposed thereopposite, independently of the remaining portions of the biasing means in the space between the inlet and the outlet, and operable thereafter, independently of the remaining portions of the biasing means, to restore the aforesaid corresponding portion of the first member thereopposite to the relatively undisplaced condition thereof when the third member has displaced the respective portion of the first member and moved on to the next successive portion in the aforesaid longitudinal direction of the line of flow.

In many of the presently preferred embodiments of the invention, the biasing means include flexure means which are interposed between the second and third members in the space between the inlet and the outlet, and each responsive to the displacement of the respective longitudinally successive portion of the first member thereopposite to assume substantially the configuration of that portion of the second member thereopposite, when the third member undergoes movement through the plane of the path corresponding to the respective portion of the first member in the aforesaid longitudinal direction of the line of flow, and to restore the respective portion of the first member to the relatively undisplaced condition thereof when the third member has displaced the respective portion and moved onto the next successive portion in the aforesaid longitudinal direction of the line of flow.

In certain of the foregoing embodiments, each of the flexure means is operable to displace a longitudinally successive portion of the first member into a convexly bowed configuration in its respective plane, relative to the third member, but resiliently yieldable to the third member to enable the respective portion to be restored to the relatively undisplaced condition thereof when the third member undergoes movement through the plane of the path corresponding to the respective portion of the first member in the aforesaid longitudinal direction of the line of flow. In some embodiments, the flexure means are interposed between the first and second members, and in certain of them, the respective flexure means are interconnected longitudinally the line of flow. For example, in many embodiments, the flexure means comprise pairs of resiliently yieldable fingers which are interconnected in strips extending longitudinally the line of flow and opposed to one another across the line of flow.

In one group of embodiments, the pairs of fingers are spaced apart from one another transversely the line of flow and there is a groove in the adjacent face of the second member and a corresponding bead on the opposite face of the third member, which mate with one another in the space between the pairs of fingers, to compress the respective portions of the first member therebetween, when the third member undergoes movement through the planes of the path corresponding to the respective portions of the first member in the aforesaid longitudinal direction of the line of flow.

In certain embodiments of the invention, the first member extends about the biasing means between the second and third members.

The fluid flow path may have a curvilinear line of flow, and in one presently preferred group of embodiments, the fluid flow path is circular and there is a circumferential interruption in the same having the inlet and outlet therein. Moreover, in some of the group, the third member is a rotary member and the fluid flow path is defined by a plurality of circular bands which are assembled about the rotary member to define a passage which has a flexible band at the inner periphery thereof.

BRIEF DESCRIPTION OF THE DRAWINGS

These features will be better understood by reference to the accompanying drawings which illustrate two of the rotary, circular path embodiments, each of which has a different passage therein.

In the drawings.

DESCRIPTION OF THE PREFERRED EMBODIMENTS

Figure 1:
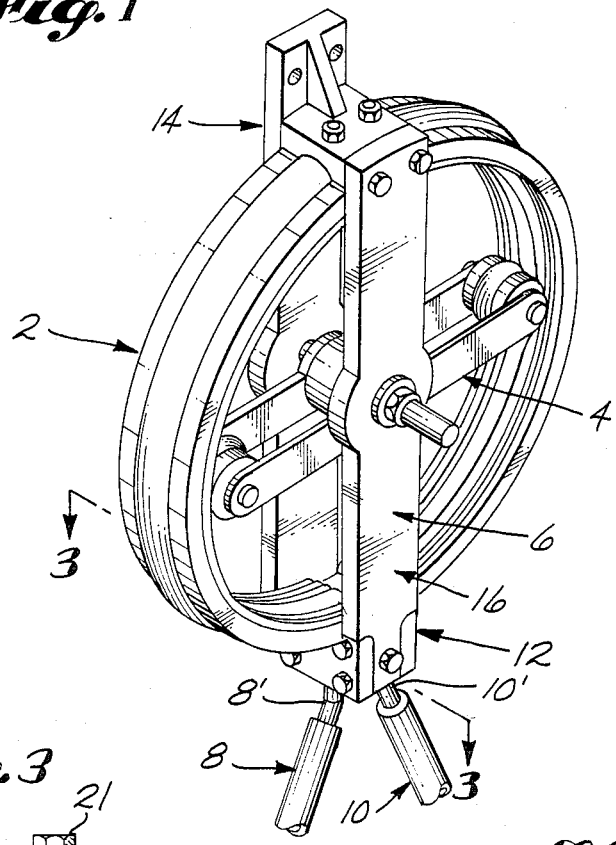
FIG. 1 is a perspective view of a rotary pump having a dome-like passage for the fluid therein.
Figure 3:
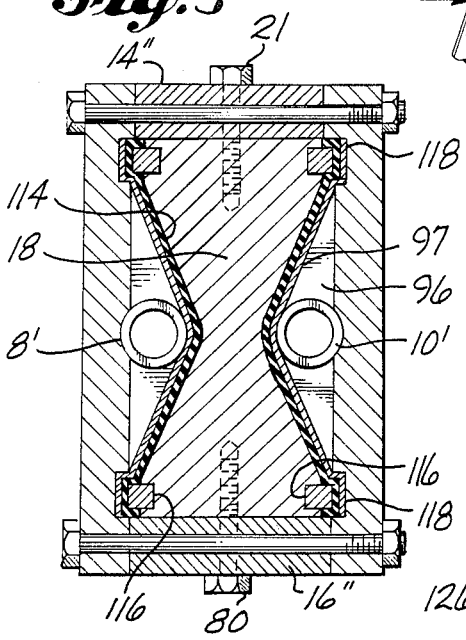
FIG. 3 is a cross-sectional view of the pump in the plane 3—3 of FIG. 1.
Figure 2:
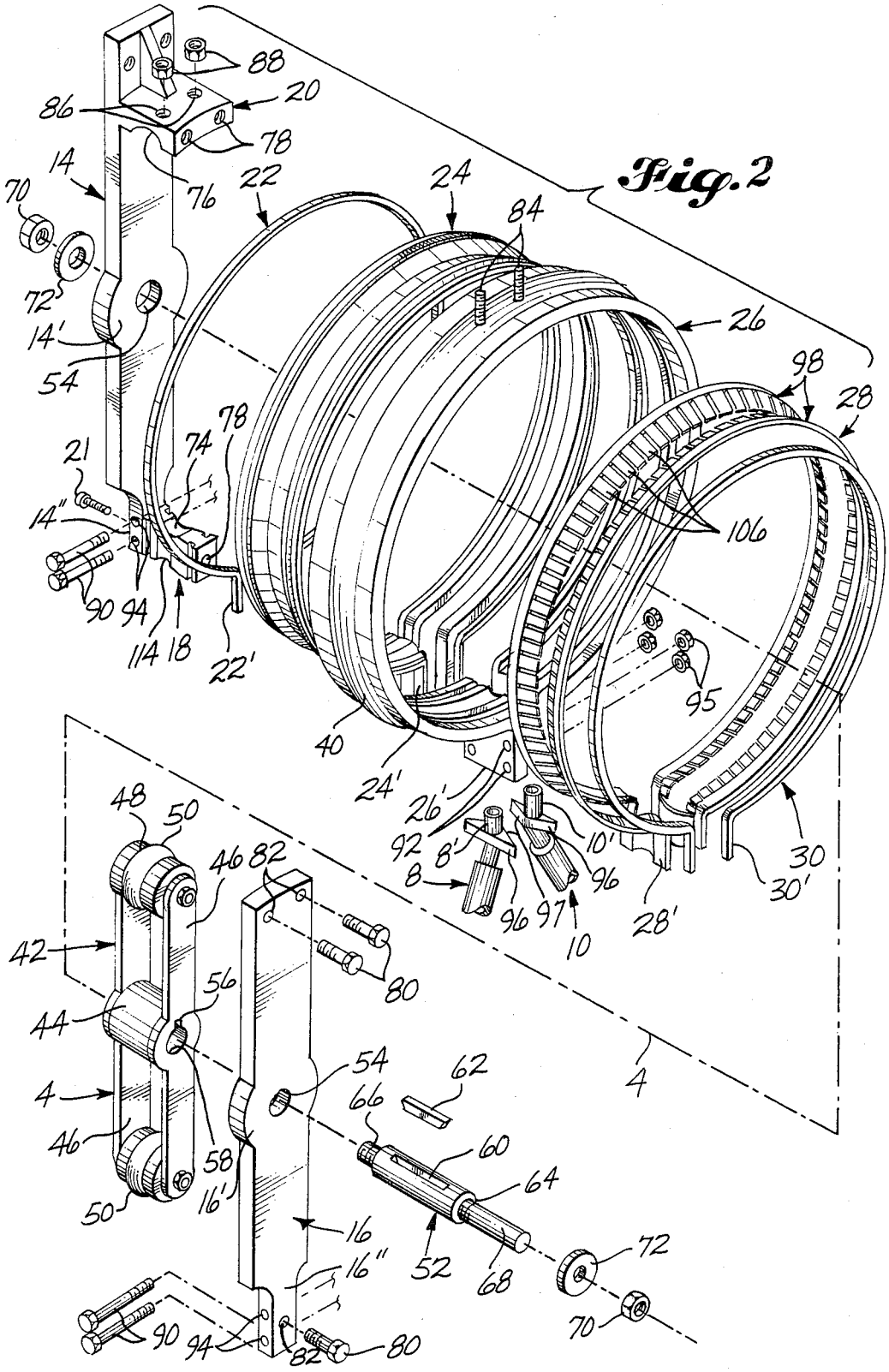
FIG. 2 is a partially exploded perspective view of the pump.
Figure 4:
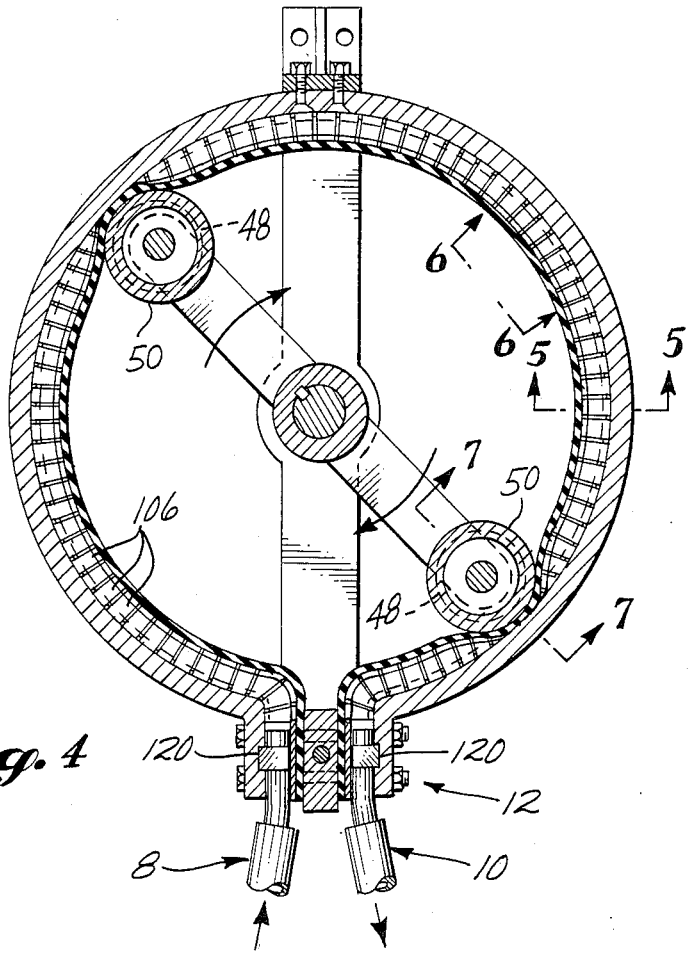
FIG. 4 is a part cross-sectional view of the pump in the central diametral plane thereof.
Figure 5:
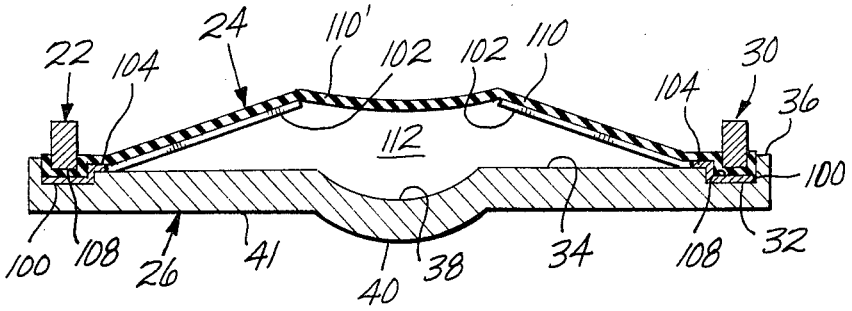
FIG. 5 is a cross-sectional view of the pump transverse the line of flow thereof in the plane 5—5 of FIG. 4.
Figure 7:
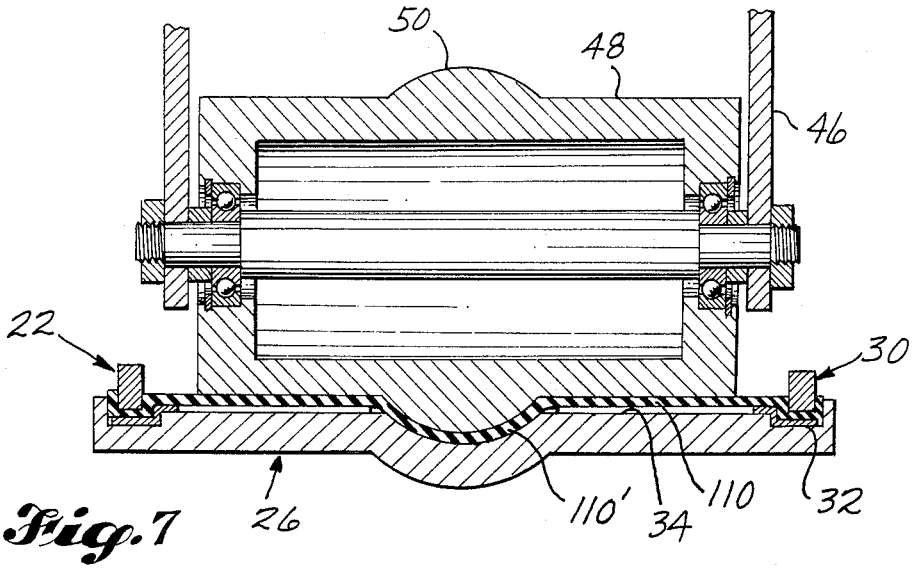
FIG. 7 is a cross-sectional view of the pump in the plane 7—7 of FIG. 4.
Figure 6:
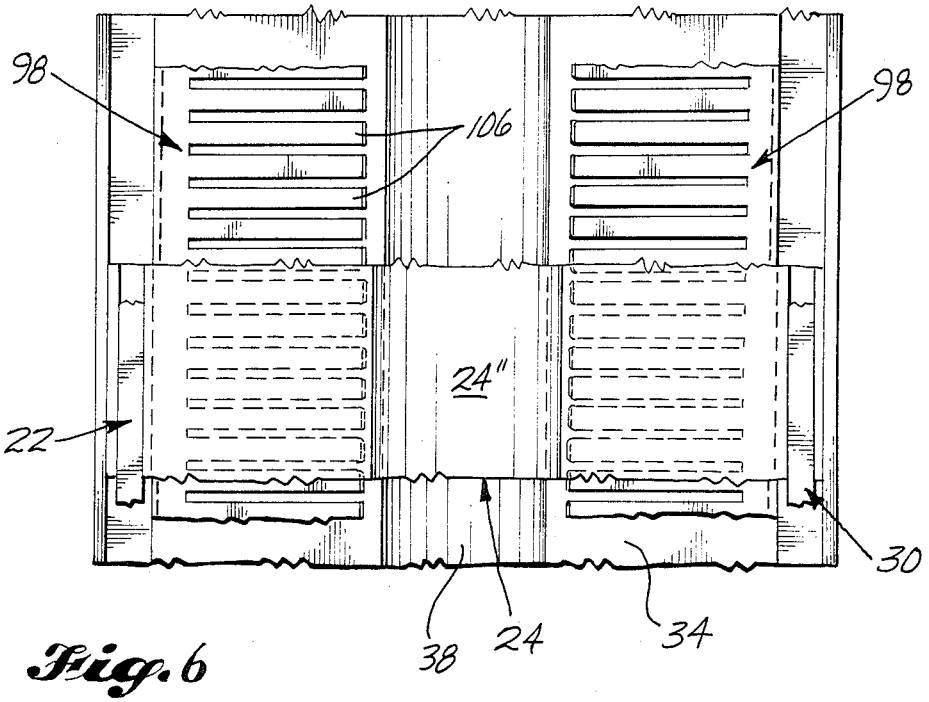
FIG. 6 is a partially removed, part radial view of the pump in the plane 6—6 of FIG. 4.

Referring first to the embodiment in FIGS. 1–7, it will be seen that the pump comprises an assemblage of circular bands forming a similarly shaped conduit 2 for fluid, a rotor 4 for driving the fluid about the circular path of the conduit, a gallows-like rectangular frame 6 for supporting the rotor and conduit in cooperative relationship with one another, and a pair of inlet and outlet tubes 8 and 10 for servicing the conduit at an interruption 12 therein. The jambs of the frame are formed by a pair of strut-like members 14 and 16 which are flat, elongated, disc-shaped at their centers and narrow-necked at their bottoms. The lintel and sill of the frame are formed by a pair of bracket-like projections 18 and 20 on the left-hand strut-like member 14 in FIGS. 1 and 2. The projections are sized and spaced apart from one another to accommodate the conduit 2 therebetween, and the lower projection 18 in FIGS. 1 and 2 is detachably secured to the member 14 by a capscrew 21 (FIG. 3) to aid in assembling the conduit within the frame, as shall be explained.

The circular bands are numbered 22, 24, 26, 28 and 30, and are axially split at the situs of the interruption 12 and equipped with relatively radially outturned flanges 22',24',26',28' and 30', respectively, that are incorporated into the interruption. The centermost band 26 in the exploded array of FIG. 2 is relatively inflexible in the axial planes thereof, and has circumferentially extending grooves 32 in the inner peripheral face 34 thereof, as well as raised edges 36 about the axial ends thereof. It also has a more rounded, swale-like groove 38 in the face 34 thereof, which extends about the axial center thereof and is accompanied by a complementary boss 40 on the outer peripheral face 41 of the band. The intermediate band 24 in the exploded array of FIG. 2 is flexible but inelastic. The intermediate band 28 is spring-like in character. The two bands are secured to the inner peripheral face 34 of the relatively inflexible band 26 by the remaining bands 22 and 30 of the array which function as retainer rings, as shall be explained.

The rotor 4 comprises an armature-like member 42 which has a central hub 44 and pairs of yoke-like arms 46 that radiate from the hub. A pair of cylindrical rollers 48 is rotatably clevised to the radially outlying ends of the arms, and each roller has a raised bead 50 about the cylindrical surface thereof which is adapted to mate with the central groove 38 in the inner peripheral face 34 of the relatively inflexible band 26. The armature-like member 42 is mounted on a shaft 52 which is keyed to the same and adapted to be trunnioned in oppositely disposed holes 54 in the disced center portions 16 of the jambs 14, 16 of the frame. The keyway can be seen at 56 in the bore 58 of the hub 44, and the body of the shaft has a radially opposing slot 60 therein to receive the key 62. Threading 64 on the reduced diameter trunnions 66 and 68 of the shaft enable it to be rotatably secured within the frame, axially of the holes 54, using pairs of nuts 70 and corresponding washers 72 on the respective trunnions. In addition, one trunnion, 68, is axially elongated to form an arbor for powering the rotor.

The projections 18, 20 on the jamb 14 have opposing, tangentially extending swale-like grooves 74 and 76 in the radially inwardly oriented faces thereof, which for reasons to be explained, are complementary to the bead 50 of the rollers, and the outer peripheral boss 40 of the relatively inflexible band 26, respectively. Also, the projections 18, 20 have tapped holes 78 in the axially inwardly oriented faces thereof, to receive three capscrews 80 used in assembling the frame. The capscrews 80 are inserted through registering holes 82 in the right-hand jamb 16 to secure it to the left-hand jamb 14 after the conduit is partially assembled between the projections. Meanwhile, the conduit is positioned on the upper projection 20 by engaging a pair of radially outstanding stud bolts 84 on the boss 40 of the band 26, in radially oriented holes 86 in the projection 20. Nuts 88 are applied to the bolts 84 to secure the conduit to the projection; and in addition, long clamping bolts 90 are passed through tangentially oriented holes 92 in the flanges 26' of the relatively inflexible band 26 and matching holes 94 in the narrow-necked bottom portions 14'' and 16'' of the jambs, to enable the interruption to be secured with accompanying nuts 95, as shall be explained. Firstly, however, the flanges 22', 24', 28' and 30' of the bands 22, 24, 28 and 30, and plug-like collars 96 on the nipple-like ends 8' and 10' of the inlet and outlet tubes 8 and 10, are incorporated into the interruption to complete the assembly, as shall be explained. The opposing faces 97 of the collars are dome-shaped, for reasons which will be explained.

The spring-like band 28 is bifurcated about the circumference thereof so that only the flanges 28' of the band operate to join the resulting spaced, axially opposed sections 98 of the band. Moreover, the axial end edges 100 of the sections are stepped about the circumference thereof to seat in the grooves 32 of the relatively inflexible band 26 when the five bands are assembled in the conduit. Meanwhile, the axially opposed edge portions 102 of the sections are bent radially outwardly from the plane of the steps 104 of the edges 100 to give the band a somewhat arched or domed cross-section in planes axial thereof. Also, the edge portions 102 are mutually symmetrically digitated in axial planes of the band, so that they have oppositely disposed sets of deeply divided fingers 106 therein. The sets are spaced apart from one another axially of the band, however, and remain so when flattened into the plane of the steps 104. Moreover, when so flattened, the spacing between the sets approximates the width of the groove 38 in the face 34 of the relatively inflexible band 26, so that the bead 50 on the rollers 48 can mate with the groove during the operation of the pump, as shall be explained.

The flexible band 24 is constructed from a fiber reinforced material that is flexible but relatively inelastic, such as that used in belting. In addition, it is superimposed on the inner peripheral face of the spring-like band 28 to assume a normally flexed condition, as illustrated in the cross-sectional view of FIG. 5. This is accomplished by overlaying the circumferential edge portions 108 of the flexible band on the edge portions 100 of the spring-like band, seating the resepective pairs of edge portions in the grooves 32 of the band 26, and clamping the respective pairs of edge portions to the band 26 with the retainer rings 22, 30. Meanwhile, the intermediate body portion 110 of the band 24 is flexed into the same arched configuration as that of the fingers 106 of the band 28, so that a dome-like passage 112 is developed between the relatively flexible and inflexible bands 24 and 26, about the circumference of the conduit. Also, the center section 110' of the arch is supported between the sets of fingers so that it lies opposite the groove 38 on one hand, and the bead 50 of the rollers on the other.

The tangentially oriented faces of the lower projection 18 on the left-hand jamb 14 also have radially extending swale-like grooves 114 (FIG. 3) therein corresponding to the domed configuration of the faces 97 of the collars 96 on the nipples of the tubes 8 and 10. In addition, the faces of the projection have narrower, radially extending grooves 116 adjacent the axial ends thereof which are adapted to accommodate the flanges 22' and 30' of the retainer rings 22, 30. Meanwhile, the opposing faces of the flanges 26' of the relatively inflexible band 26 have similarly disposed grooves 118 therein that are adapted to accommodate the circumferential edge portions 108, 100 of the bands 24, 28 in the same manner as were the grooves 32. They also have axially extending grooves 120 (FIG. 4) therein adapted to accommodate the collars 96 of the tubes 8, 10. In assembling the pump, the projection 18 is detached from the jamb 14 and the five bands 22–30 are assembled with one another, positioned abreast of the jamb and bolted to the upper projection 20 at 84, 86. Additionally, the armature-like member 42 is rotatably mounted on the shaft 52 in the jamb. Then the projection 18 is reattached to the jamb 14, the collared nipples 8', 10' of the tubes 8, 10 are inserted between the grooves 114 of the projection 18 and the flanges 26' of the band 26, and the right-hand jamb 16 is added to the assembly and secured to the ends of the projections with the trunnion 68 of the shaft 52 projecting therefrom as shown in FIG. 1.

The rotor 4 is sized in diameter so that when it is rotated, the rollers 48 of the same each compress circumferentially successive portions 24'' of the band 24 into the plane of the step 104 of the band 28 against the bias of the respective circumferentially successive pairs of fingers 106 underlying the band 24. See FIG. 7. Meanwhile, the beads 50 of the rollers depress the center sections 110' of the portions 24'' into the groove 38 to take up the additional material of the portions. At the interruption 12, however, the beads simply mate with the groove 74 of the projection 18 in crossing the interruption. The effect is to constrict the corresponding circumferentially successive portions of the passage 112 in the path of each roller, thus driving any fluid in the conduit along the length of the passage ahead of the roller. The fluid is intaken from the tube 8 and delivered to the tube 10 at the interruption 12, thus pumping the fluid from one tube to the other. Meanwhile, as each roller disengages from each successive portion 24'' of the band 24, the bias of the accompanying fingers 106 immediately returns that portion of the band to the normal domed configuration of the passage. As a result, the passage can be sized to any desired configuration and scale since the pump does not rely on the character and dimensions of the material in the band 24 as a means for restoring the cross-section of the passage following the disengagement of the rollers from the respective portions 24'' of the band.

Figure 8:
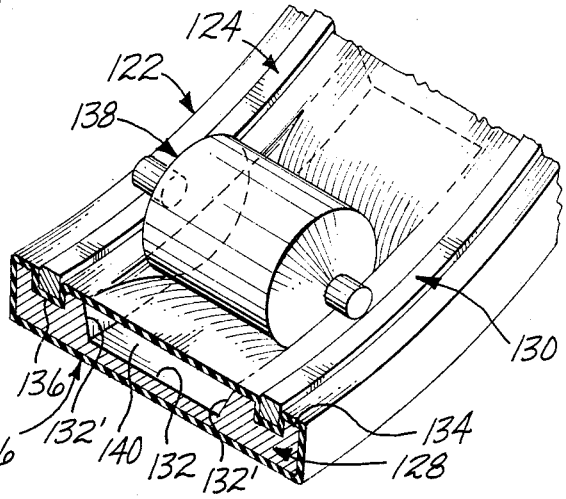
FIG. 8 is a part perspective cross-sectional view of a pump having a sump-like passage for the fluid therein.

Referring next to FIG. 8, it will be seen that in this case the conduit 122 comprises only four circular bands 124, 126, 128 and 130, and the flexible band 126 is membranous, highly elastic in nature, and sheathed about the perimeter of the relatively inflexible band 128. The four bands are axially split and coaxially assembled in the manner of FIGS. 1–7, but as seen, the band 128 has a relatively wide circumferentially extending groove 132 about the center of the inner peripheral face 134 thereof. The membranous elastically flexible band 126 is stretched taut across the width of the groove by clamping it in accompanying circumferentially extending grooves 136 about the face of the band adjacent the axial edges thereof, again using a pair of retainer bands 124 and 130 in the manner of FIGS. 1–7. Moreover, the rollers 138 of the rotor are adapted to span the full width of the groove 132 at the bottom thereof, and the sidewalls 132' of the groove are slightly inwardly tapered toward the bottom so that each rotor compressively distends the band into the bottom of the groove as it passes, thus effectively constricting circumferentially successive portions of the sump-like passage 140 defined within the groove 132 so as to drive any fluid in the conduit along the length of the passage ahead of the roller.

What is claimed is:

1. In a peristaltic pump, means including a pair of discrete and separable first and second members extending opposite one another and having yieldable biasing means operatively coextensively disposed opposite the bodies thereof to cause the members to separate from one another and define an elongated fluid flow path therebetween which has an inlet and an outlet spaced apart from one another lengthwise the line of flow thereof, and a third member which is movable lengthwise the line of flow of the path in engagement with the first member, the first and second members being displaceable by flexure and resistant to flexure, respectively, in those cross-sectional planes of the path transverse the line of flow thereof, and operatively interconnected with one another in the path defining condition thereof so that when the third member undergoes movement through the respective planes in the longitudinal direction of the line of flow relatively toward the outlet from the inlet, it displaces each longitudinally successive portion of the first member in the direction opposed to the bias of the corresponding longitudinally successive portion of the biasing means operatively disposed thereopposite, to progressively constrict the cross-section of the path from plane to plane and drive the fluid along the path, and the biasing means being separate and detached from the bodies of the first and second members, externally thereof, so that the biasing means are operable to separate simultaneously all mutually opposing portions of the first and second members from one another over the entire length of the flow path from the inlet to the outlet thereof, but each of the respective portions of the biasing means is yieldable to the displacement of the corresponding longitudinally successive portion of the first member operatively disposed thereopposite, independently of the remaining portions of the biasing means in the space between the inlet and the outlet, and operable thereafter, independently of the remaining portions of the biasing means, to restore the aforesaid corresponding portion of the first member thereopposite to the relatively undisplaced condition thereof when the third member has displaced the respective portion of the first member and moved on to the next successive portion in the aforesaid longitudinal direction of the line of flow.

2. The peristaltic pump according to claim 1 wherein the biasing means include flexure means which are interposed between the second and third members in the space between the inlet and the outlet and each responsive to the displacement of the respective longitudinally successive portion of the first member thereopposite to assume substantially the configuration of that portion of the second member thereopposite, when the third member undergoes movement through the plane of the path corresponding to the respective portion of the first member in the aforesaid longitudinal direction of the line of flow, and to restore the respective portion of the first member to the relatively undisplaced condition thereof when the third member has displaced the respective portion and moved onto the next successive portion in the aforesaid longitudinal direction of the line of flow.

3. The peristaltic pump according to claim 1 wherein the biasing means include flexure means which are interposed between the second and third members in the space between the inlet and the outlet and each operable to displace a longitudinally successive portion of the first member into a convexly bowed configuration in its respective plane, relative to the third member, but resiliently yieldable to the third member to enable the respective portion to be restored to the relatively undisplaced condition thereof when the third member undergoes movement through the plane of the path corresponding to the respective portion of the first member in the aforesaid longitudinal direction of the line of flow.

4. The peristaltic pump according to claim 3 wherein the flexure means are interposed between the first and second members.

5. The peristaltic pump according to claim 4 wherein the respective flexure means are interconnected longitudinally the line of flow.

6. The peristaltic pump according to claim 5 wherein the flexure means comprise pairs of resiliently yieldable fingers which are interconnected in strips extending longitudinally the line of flow and opposed to one another across the line of flow.

7. The peristaltic pump according to claim 3 wherein the first member extends about the biasing means between the second and third members.

8. The peristaltic pump according to claim 1 wherein the fluid flow path has a curvilinear line of flow.

9. The peristaltic pump according to claim 1 wherein the fluid flow path is circular and there is a circumferential interruption in the same having the inlet and outlet therein.

10. The peristaltic pump according to claim 9 wherein the third member is a rotary member and the fluid flow path is defined by a plurality of circular bands which are assembled about the rotary member to define a passage which has a flexible band at the inner periphery thereof.

11. In a peristaltic pump, means including a pair of first and second members extending opposite one another and having biasing means operatively co-extensively disposed thereopposite to cause the members to define an elongated fluid flow path having an inlet and an outlet spaced apart from one another lengthwise the line of flow thereof, and a third member which is movable lengthwise the line of flow of the path in engagement with the first member, the first and second members being adapted to be displaced by flexure and to resist flexure, respectively, in those cross-sectional planes of the path transverse the line of flow thereof, and being operatively interconnected with one another so that when the third member undergoes movement through the respective planes in the longitudinal direction of the line of flow relatively toward the outlet from the inlet, it displaces each longitudinally successive portion of the first member in the direction opposed to the bias of the corresponding longitudinally successive portion of the biasing means operatively disposed thereopposite, independently of the remaining portions of the biasing means in the space between the inlet and the outlet, to progressively constrict the cross-section of the path from plane to plane and drive the fluid along the path, each of the respective portions of the biasing means being operable independently of the remaining portions of the biasing means to restore the corresponding portion of the first member operatively disposed thereopposite to the relatively undisplaced condition thereof when the third member has displaced the respective portion of the first member and moved on to the next successive portion in the aforesaid longitudinal direction of the line of flow, the biasing means including flexure means which are interposed between the first and second members in the space between the inlet and the outlet and each operable to displace a longitudinally successive portion of the first member into a convexly bowed configuration in its respective plane, relative to the third member, but resiliently yieldable to the third member to enable the respective portion to be restored to the relatively undisplaced condition thereof when the third member undergoes movement through the plane of the path corresponding to the respective portion of the first member in the aforesaid longitudinal direction of the line of flow, and the flexure means comprising pairs of resiliently yieldable fingers which are interconnected in strips extending longitudinally the line of flow and opposed to one another across the line of flow.

12. The peristaltic pump according to claim 11 wherein the fingers in each pair are opposed to one another transversely the line of flow.

13. The peristaltic pump according to claim 12 wherein the pairs of fingers are spaced apart from one another transversely the line of flow and there is a groove in the adjacent face of the second member and a corresponding bead on the opposite face of the third member, which mate with one another in the space between the pairs of fingers, to compress the respective portions of the first member therebetween, when the third member undergoes movement through the planes of the path corresponding to the respective portions of the first member in the aforesaid longitudinal direction of the line of flow.

14. In a peristaltic pump, means including a pair of mutually opposing first and second members which define an elongated fluid flow path having an inlet and outlet spaced apart lengthwise the line of flow thereof, one of said members having a bowed configuration relative to the other in those cross-sectional planes of the path transverse the line of flow thereof when the members are disposed in the normal condition thereof, and a third member which is movable lengthwise the line of flow of the path in engagement with the first member, said first and second members being adapted to flex and resist flexure, respectively, in the aforesaid transverse cross-sectional planes of the path, and being operatively interconnected with one another so that when the third member undergoes movement through the respective planes in the longitudinal direction of the line of flow relatively toward the outlet from the inlet, it flexes longitudinally successive portions of the first member against the resistance of the second member to progressivly constrict the cross-section of the path from plane to plane and drive the fluid along the path, there being biasing means mounted in the pump so that they are separate from the first member, but operatively disposed opposite each of the longitudinally successive portions of the first member in the space between the inlet and outlet, for over the entire length of the space between the same, when the third member travels in the aforesaid longitudinal direction of the line of flow, to restore each portion of the first member to the normal condition thereof when the third member has flexed the respective portion and moved onto the next successive portion in the aforesaid longitudinal direction of the line of flow, the biasing means including a series of flexure means extending between the second and third members over the entire length of the space between the inlet and the outlet, and each of which is operable to flex a longitudinally successive portion of the first member into a convexly bowed configuration in its respective plane, relative to the third member, when the first member is in the normal condition thereof, but is resiliently yieldable to the third member to enable the respective portion to assume an operatively relaxed condition when the third member undergoes movement through the plane of the respection portion in the aforesaid longitudinal direction of the line of flow, the flexure means comprising pairs of resiliently yieldable fingers which are interconnected in strips that extend longitudinally of the path between the first and second members and are opposed to one another transversely of the path.

15. The peristaltic pump according to claim 14 wherein the fingers in each pair are opposed to one another transversely of the line of flow.

16. The peristaltic pump according to claim 14 wherein the pairs of fingers are operatively spaced apart from one another transversely of the line of flow, and there is a groove in the adjacent face of the second member and a corresponding head on the opposite face of the third member, which mate with one another in the space between the pairs of fingers, to compress the respective portions of the first member therebetween, when the third member undergoes movement through the aforesaid transverse cross-sectional planes of the path in the aforesaid longitudinal direction of the line of flow.

17. In a peristaltic pump, a pair of mutually opposing first and second members which define an elongated fluid flow path and one of which has a bowed configuration relative to the other in those cross-sectional planes of the path transverse the line of flow thereof when the members are disposed in the normal condition thereof, and a third member which is movable lengthwise of the line of flow in engagement with the first member, the first and second members being adapted to flex and to resist flexure, respectively, in the aforesaid transverse cross-sectional planes of the path, and being operatively interconnected with one another so that when the third member undergoes movement through the respective planes in one longitudinal direction of the line of flow, it flexes longitudinally successive portions of the first member against the resistance of the second member to progressively constrict the cross-section of the path from plane to plane and drive the fluid along the path, there being a plurality of biasing means having the second and third members each of which is operable to flex a longitudinally successive portion of the first member into a convexly bowed configuration in its plane relative to the third member when the first member is in the normal condition thereof, but is resiliantly yieldable to the third member to enable the respective portion to assume an operatively relaxed condition when the third member undergoes movement through the plane of the respective portion in the one longitudinal direction of the line of flow, said biasing means comprising pairs of resiliantly yieldable fingers which are interconnected in strips, that extend longitudinally of the line of flow between the first and second members and are opposed to one another transversely of the line of flow.

18. The peristaltic pump according to claim 17 wherein the pairs of fingers are operatively spaced apart from one another transversely of the line of flow, and there is a groove in the adjacent face of the second member and a corresponding bead on the opposing face of the third member, which mate with one another in the space between the pairs of fingers, to compress the respective portions of the first member therebetween, when the third member undergoes movement through the transverse cross-sectional planes of the path in the aforesaid one longitudinal direction of the line of flow.

19. The peristaltic pump according to claim 17 wherein the fingers in each pair are opposed to one another transversely of the line of flow.

* * * * *